US012241693B2

(12) United States Patent
Byrne

(10) Patent No.: US 12,241,693 B2
(45) Date of Patent: Mar. 4, 2025

(54) DOUBLE STACK V HEAT EXCHANGER

(71) Applicant: Evapco, Inc., Taneytown, MD (US)

(72) Inventor: Tom Byrne, Frederick, MD (US)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 17/180,205

(22) Filed: Feb. 19, 2021

(65) Prior Publication Data

US 2021/0254898 A1 Aug. 19, 2021

Related U.S. Application Data

(60) Provisional application No. 62/978,667, filed on Feb. 19, 2020.

(51) Int. Cl.

| | |
|---|---|
| ***F28D 3/02*** | (2006.01) |
| ***F28D 1/04*** | (2006.01) |
| ***F28D 3/04*** | (2006.01) |
| ***F28F 1/12*** | (2006.01) |

(52) U.S. Cl.

CPC ..... *F28D 3/02* (2013.01); *F28D 1/0443* (2013.01); *F28D 3/04* (2013.01); *F28F 1/12* (2013.01); *F28F 2280/02* (2013.01); *F28F 2280/06* (2013.01)

(58) Field of Classification Search

CPC .... F28D 1/0426; F28D 1/0443; F28D 1/0452; F28D 3/02; F28D 3/04; F28D 5/00; F28F 1/12; F28F 2280/02; F28F 2280/06

See application file for complete search history.

(56) References Cited

U.S. PATENT DOCUMENTS

| | | | | |
|---|---|---|---|---|
| 3,363,885 | A | 1/1968 | Meek | |
| 3,384,165 | A * | 5/1968 | Mathews | F28D 5/00 D23/314 |
| 8,297,344 | B2 * | 10/2012 | Vouche | F28B 1/06 165/122 |
| 2009/0115080 | A1 * | 5/2009 | Dorin | F28D 5/00 261/159 |
| 2009/0283245 | A1 | 11/2009 | Hentschel et al. | |
| 2011/0192188 | A1 * | 8/2011 | Nickey | F28D 1/0435 165/104.34 |
| 2013/0092352 | A1 * | 4/2013 | Martin | F28F 9/00 165/68 |

(Continued)

OTHER PUBLICATIONS

International Search Report issued in corresponding International Patent Application No. PCT/US21/18796 on May 18, 2021.

*Primary Examiner* — Eric S Ruppert
*Assistant Examiner* — Hans R Weiland
(74) *Attorney, Agent, or Firm* — Whiteford, Taylor & Preston, LLP; Peter J. Davis

(57) ABSTRACT

A modular double V stacked dry or adiabatic heat exchanger having a bottom module with two heat exchangers arranged in a V-shape, a top module configured to rest atop and be supported by the bottom module and having two heat exchangers configured to continue and extend the V-shape formed by the two bottom heat exchangers, and a fan module configured to rest atop and be supported by the top module. The modules are factory assembled and configured to for easy shipping and connection to one-another on-site. Adiabatic pads or spray nozzles may be provided to pre-cool the air entering the system.

13 Claims, 13 Drawing Sheets

(56) References Cited

U.S. PATENT DOCUMENTS

| | | | | |
|---|---|---|---|---|
| 2014/0262147 | A1* | 9/2014 | Pawlick | F28D 1/0426 165/67 |
| 2015/0122455 | A1* | 5/2015 | Fox | F28B 1/06 165/67 |
| 2017/0010045 | A1* | 1/2017 | Yang | F28D 1/0443 |
| 2017/0037650 | A1* | 2/2017 | Maurer | F28C 1/00 |
| 2017/0082370 | A1* | 3/2017 | Strumenti | F28D 5/02 |
| 2017/0261274 | A1* | 9/2017 | Köcher | F28D 3/00 |
| 2018/0231264 | A1* | 8/2018 | Vadder | F28D 1/024 |
| 2018/0283814 | A1* | 10/2018 | Najafifard | F28C 1/14 |
| 2019/0128614 | A1* | 5/2019 | Bultot | F28D 1/0426 |
| 2019/0137183 | A1 | 5/2019 | Byrne | |
| 2019/0154342 | A1* | 5/2019 | Jin | F28D 1/0426 |
| 2019/0170459 | A1* | 6/2019 | Rasmussen | F28F 25/10 |

* cited by examiner

DOUBLE STACK V HEAT EXCHANGER

BACKGROUND OF THE INVENTION

Field of the Invention

The present invention relates to air-cooled coil-type heat exchangers.

Description of the Background

Air-cooled heat exchangers remove heat from a working fluid by transferring that heat to the air. Air-cooled heat exchangers typically consist of tubes connected to fins. The working fluid is sent through the inside of the tubes and the heat is conducted to the outside of the tubes and the fins. Air passing over the fins and tubes removes this heat; one or more fans are generally used to move the air. The working fluid can be a liquid, a gas, a condensing refrigerant, or any other fluid that needs to have heat removed. The tubes are typically constructed of copper, aluminum, or stainless steel but other metals and non-metals have been used. Fins are typically made from copper or aluminum but other thermally conductive materials have been used.

For heat to be removed from the working fluid, the temperature of the working fluid must be greater than the temperature of the air entering the cooler. The greater the temperature difference between the air entering the cooler and the working fluid the less is air volume needed to remove the heat; hence the less fan horsepower is needed to move the air.

SUMMARY OF THE INVENTION

According to the invention, there is presented a modular V-shaped heat exchange assembly in which a first, lower module contains two heat exchangers arranged in a V-shape, and a second upper module containing two additional heat exchangers is stacked on top of the first, lower module, and where the two heat exchangers in the upper module continue and extend the V-shape that is formed by the bottom two heat exchangers. The V shape results in more equal air flow through the heat exchanger. Finally, a fan module is placed atop the upper heat exchange module. According to various embodiments, the modules are factory pre-assembled, sized and configured for ease of shipping and assembly. The present invention provides substantially higher fluid flow rates and greater heat exchange capacity compared to prior art V-shaped air-cooled heat exchangers using the same footprint, especially taking into account the required spacing between devices to allow for sufficient air flow. Multiple double V-stacked cells according to the invention may also be arranged in a line or rectangular array under one common fan with all air coming from the bottom. The invention may be used as a cooler for fluid cooling or as a condenser for refrigerant condensing. Optional adiabatic pads or adiabatic pre-cooling spray nozzles may be provided to pre-cool the air entering the system.

Accordingly, there is provided according to the invention, a modular V-shaped heat exchange apparatus featuring 1) a factory assembled and transportable bottom heat exchange module having a bottom module frame and two bottom module heat exchange panels arranged and supported in said bottom module frame in a V-shape, 2) a factory assembled and transportable top heat exchange module having a top module frame and two top module heat exchange panels arranged and supported in said top module frame so that said two top module heat exchange panels continue and extend the V-shape formed by said two bottom module heat exchange panels, said top heat exchange module positioned on and supported by said bottom heat exchange module; and 3) a factory assembled and transportable fan module having a fan module frame and at least one fan, said fan module positioned on top of and supported by said top heat exchange module, said at least one fan positioned and configured to draw air through said two bottom module heat exchange panels and said two top module heat exchangers.

According to further features or embodiments of the invention, each of said two bottom module heat exchange panels and said two top module heat exchange panels have an inlet header and an outlet header, said inlet header configured and located to receive hot process fluid and to distribute it to a corresponding heat exchange panel and said outlet header configured and located to receive cooled process fluid from said heat exchange panel.

According to one embodiment of the invention each of said two bottom module heat exchange panels and said two top module heat exchange panels contain the same process fluid.

According to other embodiments of the invention, at least one of said bottom module heat exchange panels and said top module heat exchange panels contains a first process fluid, and at least one other of the heat exchange panels contains a second process fluid different from said first process fluid.

According to further embodiments of the invention, at least one of the bottom module heat exchange panels and top module heat exchange panels contains a first process fluid, at least one of the other heat exchange panels contains no process fluid.

According to further embodiments of the invention, the modular V-shaped heat exchange apparatus may be fitted with adiabatic panels and/or spray nozzles configured to spray water into an air flow entering said bottom and top heat exchange modules.

According to another embodiment of the invention, each of said top module heat exchange panels share a common plane with an adjacent one of said bottom module heat exchange panels.

According to yet another embodiment of the invention, there is provided 1) a plurality of a factory assembled and transportable bottom heat exchange modules, each having a bottom module frame and two bottom module heat exchange panels arranged and supported in said bottom module frame in a V-shape, 2) a plurality of factory assembled and transportable top heat exchange modules each having a top module frame and two top module heat exchange panels arranged and supported in said top module frame so that said two top module heat exchange panels continue and extend the V-shape formed by two of said two bottom module heat exchange panels, each of said plurality of top heat exchange modules positioned on and supported by a respective bottom heat exchange modules, and wherein said bottom and top heat exchange modules are configured to receive ambient air from below; 3) an elevating frame supporting each of said plurality of bottom heat exchange modules; and 4) a fan module comprising a single fan sized and positioned to draw air through a plurality of cells, each cell comprising a top heat exchange module and a bottom heat exchange module.

According to another embodiment of the invention, there is provided a method for assembling a heat exchange apparatus, comprising the steps of:

transporting to an assembly location a factory assembled bottom heat exchange module having a bottom module frame and two bottom module heat exchange panels arranged and supported in said bottom module frame in a V-shape, transporting to said assembly location a factory assembled top heat exchange module having a top module frame and two top module heat exchange panels;

transporting to said assembly location a factory assembled fan module having a fan module frame and at least one fan, installing said bottom heat exchange module at an installation location;

mounting said top heat exchange module on top of said bottom heat exchange module, wherein said top module heat exchange panels are arranged and supported in said top module frame so that said two top module heat exchange panels continue and extend the V-shape formed by said two bottom module heat exchange panels;

and mounting said fan module on top of said top heat exchange module.

There is further provided according to the invention a method for assembling a heat exchange apparatus, comprising:

a. assembling an elevation frame at an installation location;

b. mounting on said elevation frame a plurality of a factory assembled and transportable bottom heat exchange modules, each having a bottom module frame and two bottom module heat exchange panels arranged and supported in said bottom module frame in a V-shape, c. mounting on top of each of said bottom heat exchange modules a respective factory assembled and transportable top heat exchange module having a top module frame and two top module heat exchange panels arranged and supported in said top module frame so that said two top module heat exchange panels continue and extend the V-shape formed by two of said two bottom module heat exchange panels;

d. and mounting and positioning above said top heat exchange module a fan configured to draw ambient air into a plenum formed by said elevation frame and up through a plurality of said bottom heat exchange modules and plurality of said top heat exchange modules. According to further embodiments of the invention, adiabatic pads may be mounted on said elevation frame. Alternatively or in addition, mounting spray nozzles may be mounted on said elevation frame and oriented said spray nozzles to spay water into air being drawn into or through the plenum.

Figure 1:
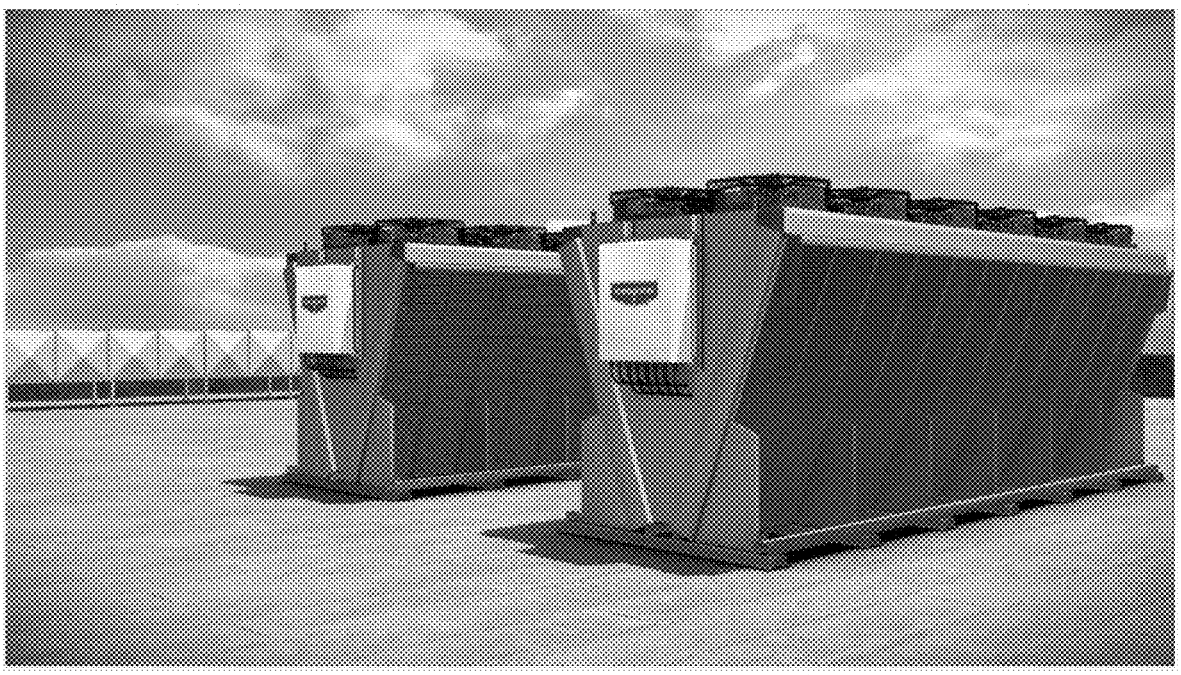
FIG. 1 is a perspective view of two V-type air cooled heat exchangers of the type that might be used in connection with the present invention.

Features in the attached drawings are numbered with the following reference numerals:

101 bottom heat exchange module
102 intermediate heat exchange module
103 top heat exchange module
105 fan module
109 bottom heat exchange coil
111 bottom module frame base section
113 bottom module frame top section
115 bottom module frame side section
121 distance between tops of bottom heat exchangers and top corners of bottom module.
125 top heat exchange coil
131 top corners of top frame module.
133 The top module frame base section
135 top module frame top section
137 top module frame side sections
139 inlet header
141 outlet header
147 intermediate header
151 adiabatic pre-cooling pad
**151*a*** top adiabatic pad
**151*b*** bottom adiabatic pads
153 top module water distribution tube coils.
157 spray nozzles

159 spray nozzle supply tube
161 water return tube
163 bottom module basin
165 pump
167 large fan module
169 elevating frame
171 very large fan module
173 intermediate module frame
175 intermediate module heat exchange coil
177 low temperature process fluid coil
179 high temperature process fluid coil
181 space between high and low process fluid

DETAILED DESCRIPTION

Figure 2:
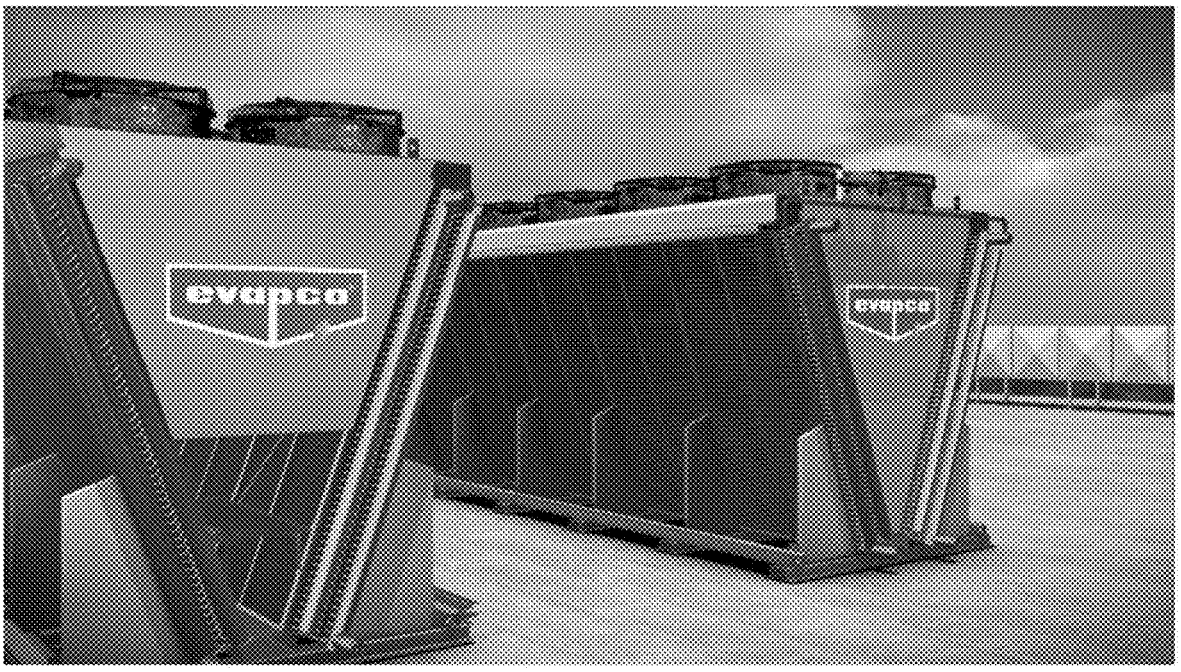
FIG. 2 is a close up perspective view of the opposite ends of the two V-type air cooled heat exchangers shown in FIG. 1.

An example of a V-shaped cooler is shown in FIGS. 1 and 2. A frame supports two heat exchange panels (also "tube bundles" or "coils"), each comprising a plurality of horizontally arranged finned tubes in a V-shaped configuration. At one end of each tube bundle or coil, the tubes are connected at an inlet end to an inlet header and to an outlet header. At an opposite end of each bundle, each horizontal tube is connected to an adjacent horizontal tube via a return bend. A hot process fluid enters the inlet header via an inlet header connection and is then distributed to the tubes from the inlet header. Cooled fluid exits the tubes via an outlet header and returned to the process/system that heated the fluid. The frame supports one or more fans at the top of the cooler and draws ambient air into the unit past the tubes and the fins and out the top of the unit.

Figure 3:
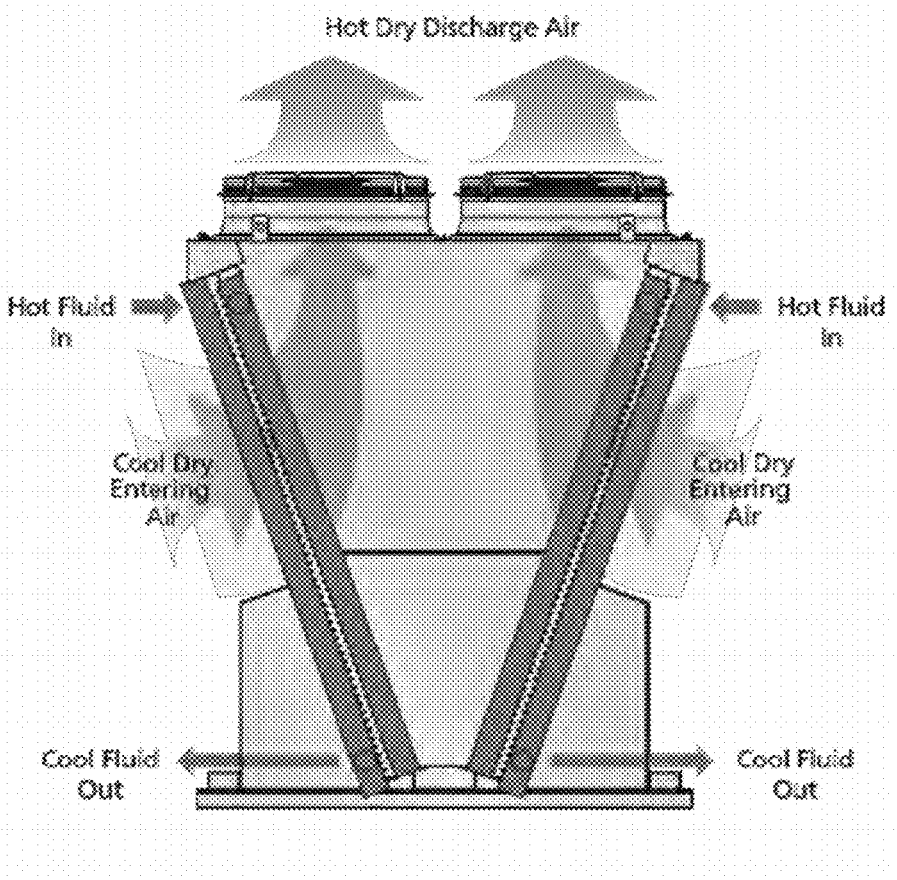
FIG. 3 is a representation of the operation of a V-type air cooled heat exchanger of the type shown in FIGS. 1 and 2.

The principles of operation of a V-shaped air-cooled heat exchanger of the type shown in FIGS. 1 and 2 is shown in FIG. 3. Hot process fluid, shown in red, enters the inlet header via the inlet header connection. From the inlet header, the hot process fluid travels transversely across the heat exchanger, generally parallel to the horizontal. Heat from the process fluid dissipates through the coil tubes' surfaces and out to the fins (not shown). Ambient air is drawn over the coil surface by the fan(s) located at the top of the unit. Heat from the process fluid transfers to the air and discharged to the atmosphere. Cool process fluid, shown in blue, exits the unit through the outlet headers.

Figure 4:
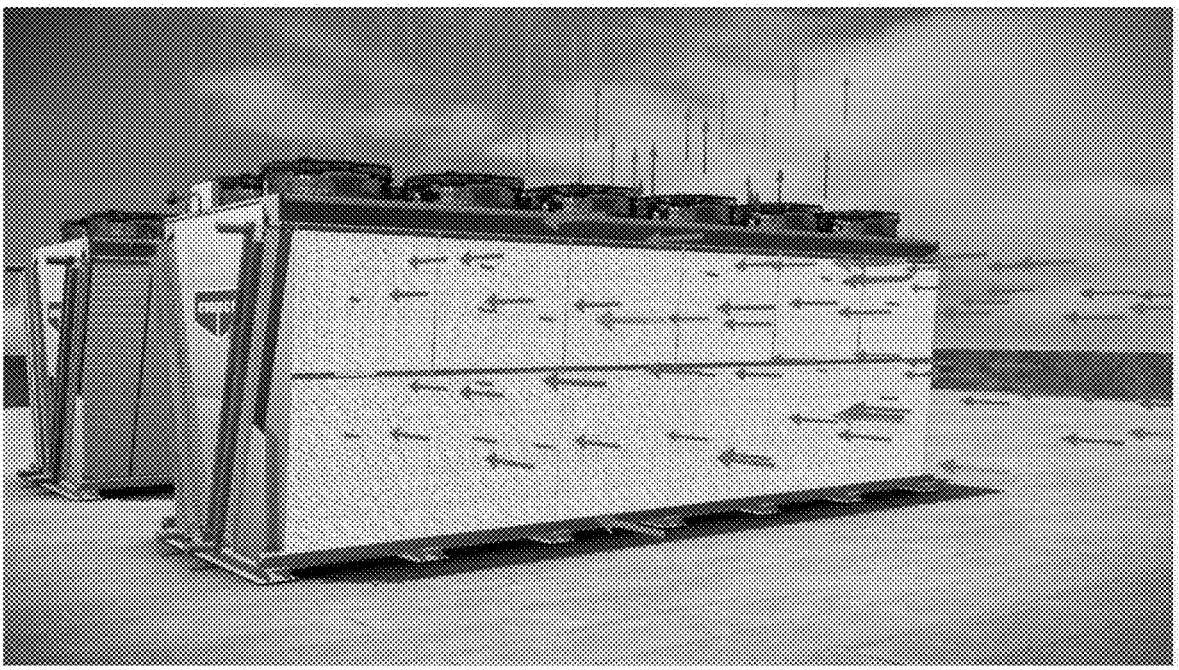
FIG. 4 shows a perspective view of two V-type air cooled heat exchangers on which adiabatic pads have been provided after market and site-mounted for pre-cooling the incoming air.
Figure 5:
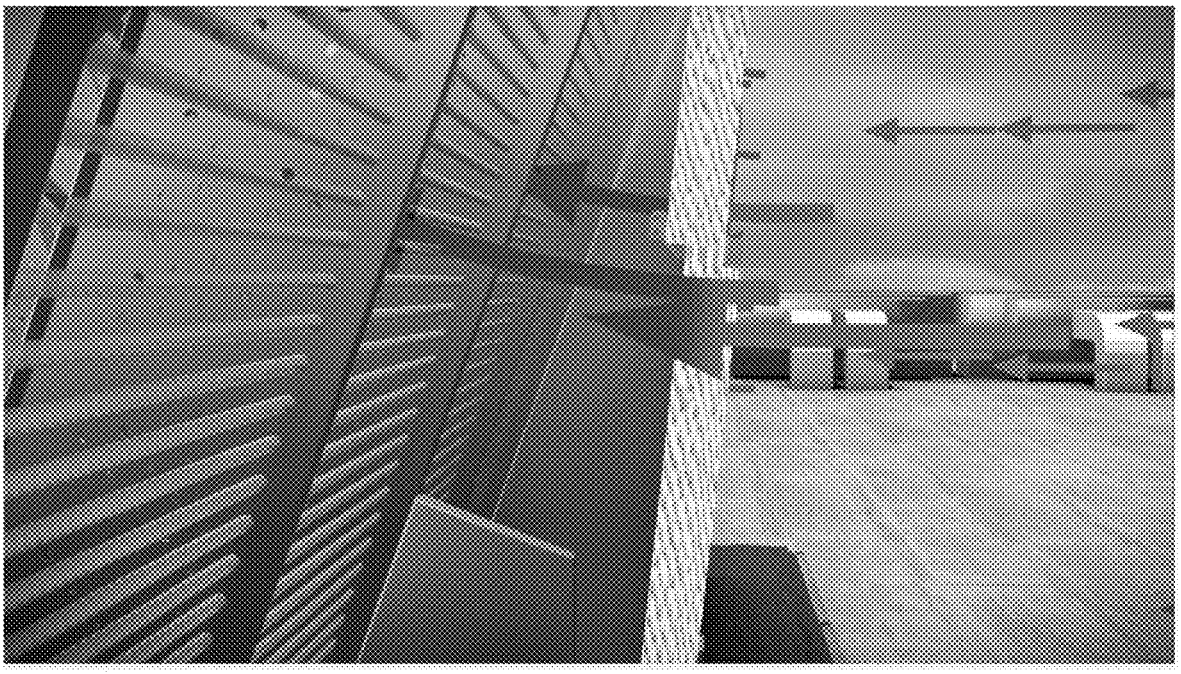
FIG. 5 shows a close-up side cutaway view of one of the V-type air cooled heat exchangers shown in FIG. 3.

An example of a V-shaped cooler with adiabatic pre-cooling pads is shown in FIGS. 4 and 5. A frame supports two heat exchange coils each comprising a plurality of horizontally arranged finned tubes in a V-shaped configuration. At one end of each tube bundle, the tubes are connected at an inlet end to an inlet header and to an outlet header. At an opposite end of each bundle, each horizontal tube is connected to an adjacent horizontal tube via a return bend. A hot process fluid enters the inlet header via an inlet header connection and is then distributed to the tubes from the inlet header. Cooled fluid exits the tubes via an outlet header and returned to the process/system that heated the fluid. Adiabatic pads are mounted along and spanning both sides of the unit left-to-right and top-to-bottom. A water distribution system drips water onto the top of the pads to saturate them. Water that is not evaporated from the pads is collected at the bottom of the unit and either send to drain or recirculated back to the top of the unit and returned to the pads. The frame supports one or more fans at the top of the cooler and draws ambient air into the unit through the saturated pads, past the tubes and the fins and out the top of the unit.

Figure 6:
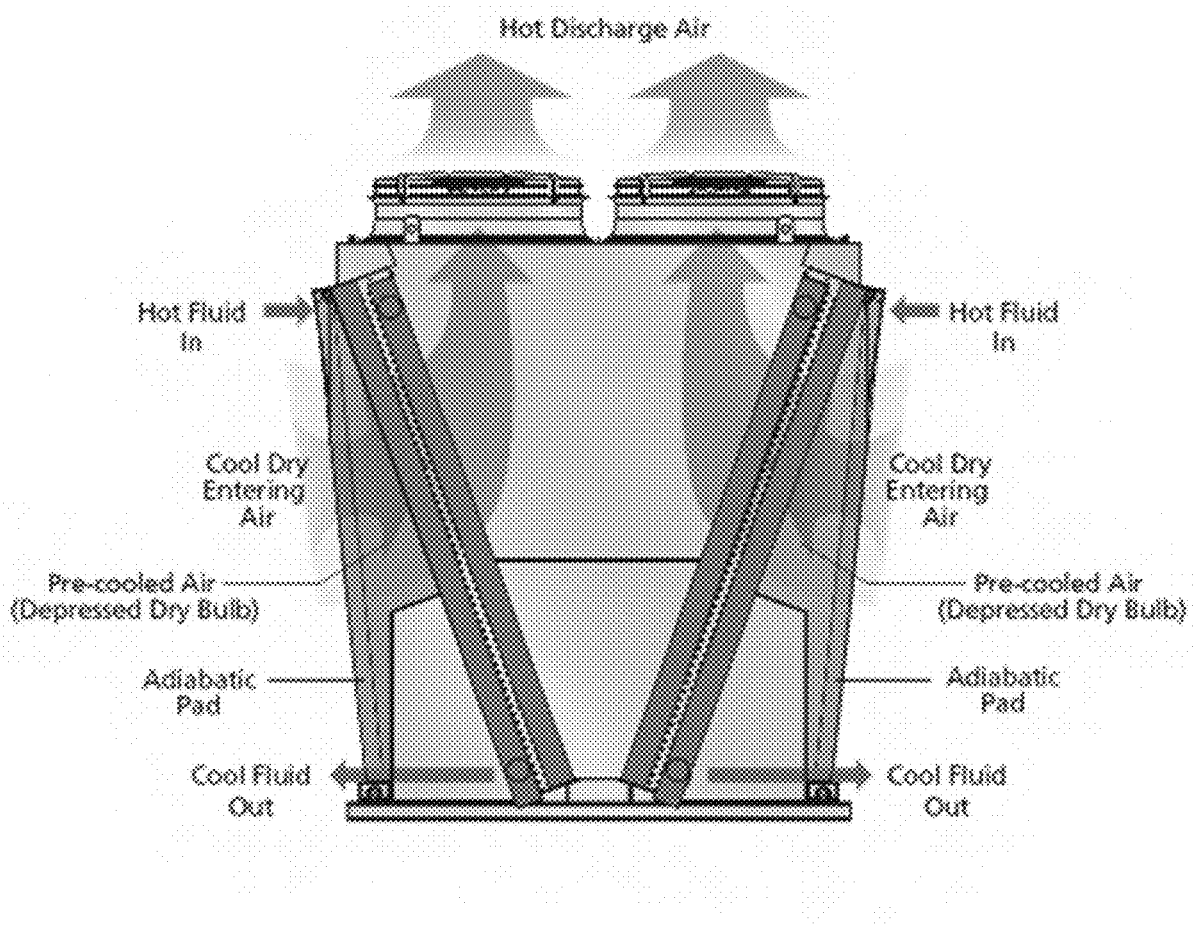
FIG. 6 is a representation of the operation of the V-type air cooled heat exchanger with pre-cooling adiabatic pads shown in FIGS. 4 and 5.

The principles of operation of a V-shaped air-cooled heat exchanger with adiabatic pads for pre-cooling the incoming air is shown in FIG. 6. Hot process fluid, shown in red, enters the inlet header via the inlet header connection. From the inlet header, the hot process fluid travels transversely across the heat exchanger, generally parallel to the horizontal. Heat from the process fluid dissipates through the coil tubes surface and out to the fins (not shown). The adiabatic system involves fully wetting a fibrous pad located in front of the coil. Ambient air is drawn through the adiabatic pre-cooling pad by the fans located on top of the unit. The air is humidified as it passes through the adiabatic pad, decreasing the dry bulb temperature within a few degrees of the wet bulb temperature. This new air temperature is referred to as the depressed dry bulb. This pre-cooled air is then drawn through the tube and fin surface, offering a substantial increase in heat rejection capability. Heat from the process fluid transfers to the air and discharged to the atmosphere. Cool process fluid, shown in blue, exits the unit through the outlet headers. In a recirculating water system, the water used to wet the adiabatic pads and which is not evaporated is collected at the bottom of the unit and recirculated to a water distribution system at the top of the pad. In a once-through water system, the water used to wet the adiabatic pads and which is not evaporated is collected and sent to a drain.

According to an alternate embodiment, instead of using adiabatic pads to pre-cool the incoming air, a V-shaped air-cooled heat exchanger may be outfitted with spray nozzles configured to spray a mist of water into the incoming air to humidify the ambient air before it is drawn past the fin and tube surfaces. A basin is situated at the bottom of the heat exchanger to collect and optionally recirculate the pre-cooling water to the spray nozzles via a recirculation pump, return pipes and water distribution pipes that distribute the pre-cooling water to the spray nozzles. According to an alternate once-through water system, the water sprayed into the incoming air and which is not evaporated is collected and sent to a drain.

FIGS. 7-10 show an embodiment in which the V-shaped air-cooled heat exchanger is formed from three modules, a bottom heat exchange module 101, a top heat exchange module 103, and a fan module 105. The bottom module 101 (FIG. 9) includes a bottom module frame, and two bottom heat exchange coils 109 supported in the bottom module frame and arranged in a V-shape. The bottom module frame may include a base section 111, a top section 113 and side sections 115 extending between the base section 111 and the top section 113. The dimensions (width and length) of the top and bottom sections 111, 113 of the bottom module frame may be, but are not necessarily, the same. The tops of the two bottom heat exchange coils 109 do not converge with the top corners 119 of the bottom module frame but instead are separated from the side sections 115 of the bottom frame module by a distance 121.

The top module 103 (FIG. 8) includes a top module frame, and two top heat exchange coils 125 supported in the top module frame so that they continue and extend the V-shape formed by the two bottom heat exchange coils 109 when the top heat exchange module 103 is placed on top of the bottom heat exchange module 101. The top heat exchange module 103 is dimensioned to fit on top of and be supported by the bottom heat exchange module 101. The top heat exchange coils 125 are inclined away from one-another from bottom to top. The bottoms of the top heat exchanger coils 125 are spaced from one-another approximately the same distance 121 that the tops of the bottom heat exchangers 109 are spaced from one-another. The tops of the top heat exchangers 125 preferably terminate at opposite top corners 131 of the top frame module. The top module frame may include a base section 133, a top section 135 and side sections 137 extending between the base section 133 and the top section 135. The dimensions (width and length) of the top and bottom sections of the top module frame may be, but are not necessarily, the same as one-another, and may be the same as the dimensions of the top and bottom sections of the bottom module frame. According to a preferred embodiment, the base section 133 of the top module frame is configured to mate with and be fixed to the top section 113 of the bottom module frame.

Each of the four heat exchange coils (two top coils 125 and two bottom coils 109) may include a dedicated inlet header 139 (shaded in red/stippling) and outlet header 141 (shaded in blue/crosshatch) connected by a plurality of tubes with horizontal segments and U-shaped return bends.

According to one embodiment, adjacent top and bottom coils are fluidically isolated from one-another. According to one aspect of this embodiment, the coils may be manufactured with different materials compatible with the process fluid allowing multiple different process fluids to be cooled in a single assembly.

According to another embodiment, the fluid to be cooled in a top heat exchange coil 125 may pass from the outlet header 141 of the top heat exchange coil 125 to the inlet header of the adjacent bottom heat exchange coil 109 via an intermediate header 147.

A fan module 105 (FIG. 7) is dimensioned and configured to rest upon and be supported by the top module 103.

Figure 11:
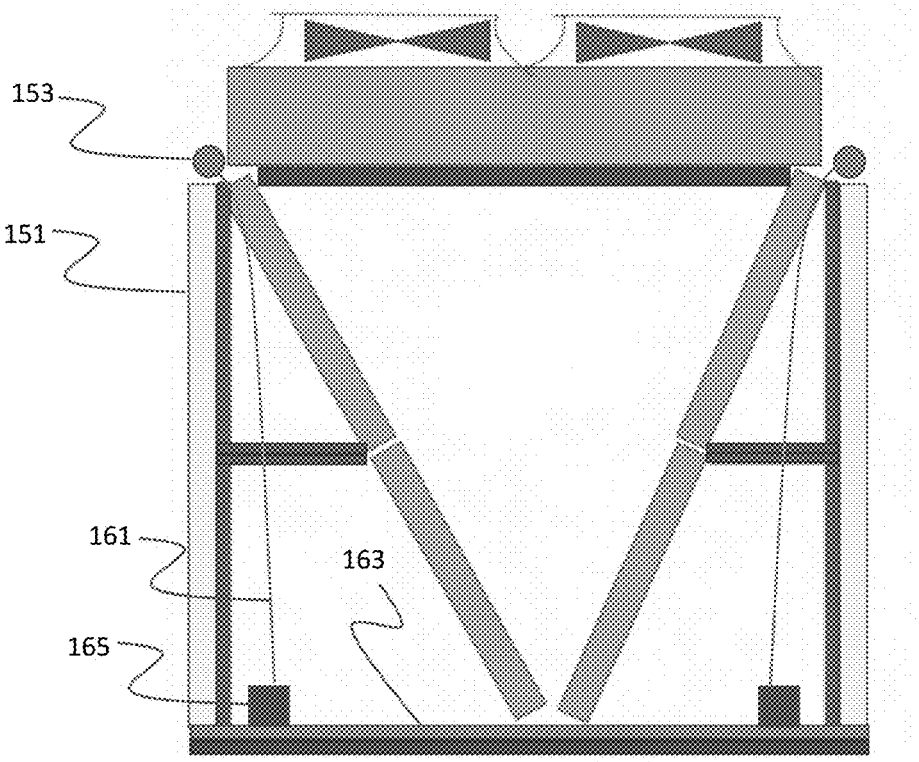
FIG. 11 is a representation of a modular double V-stack air-cooled heat exchanger with pre-cooling adiabatic pads according to an embodiment of the invention.

According to a first optional embodiment of the invention, the double-v stack heat exchanger of the invention may be provided with adiabatic pre-cooling pads, see, e.g., FIG. 11. According to another optional embodiment of the invention, each of the top and bottom modules may be fitted with adiabatic pre-cooling pads 151*a* and 151*b*, see, e.g., FIG. 15. According to this embodiment, a top module water distribution tube 153 is located above the top adiabatic pre-cooling pads 151*a* and drips or sprays water onto the top adiabatic pads. According to a first variation to this embodiment, the water that passes through the top adiabatic pads 151*a* drains into the bottom adiabatic pads 151*b*. According to a second variation of this embodiment (not shown), the water passing through the top adiabatic pads 151*a* is collected in top module water collection trays and redistributed to the bottom module adiabatic pads 151*b*.

Figure 12:
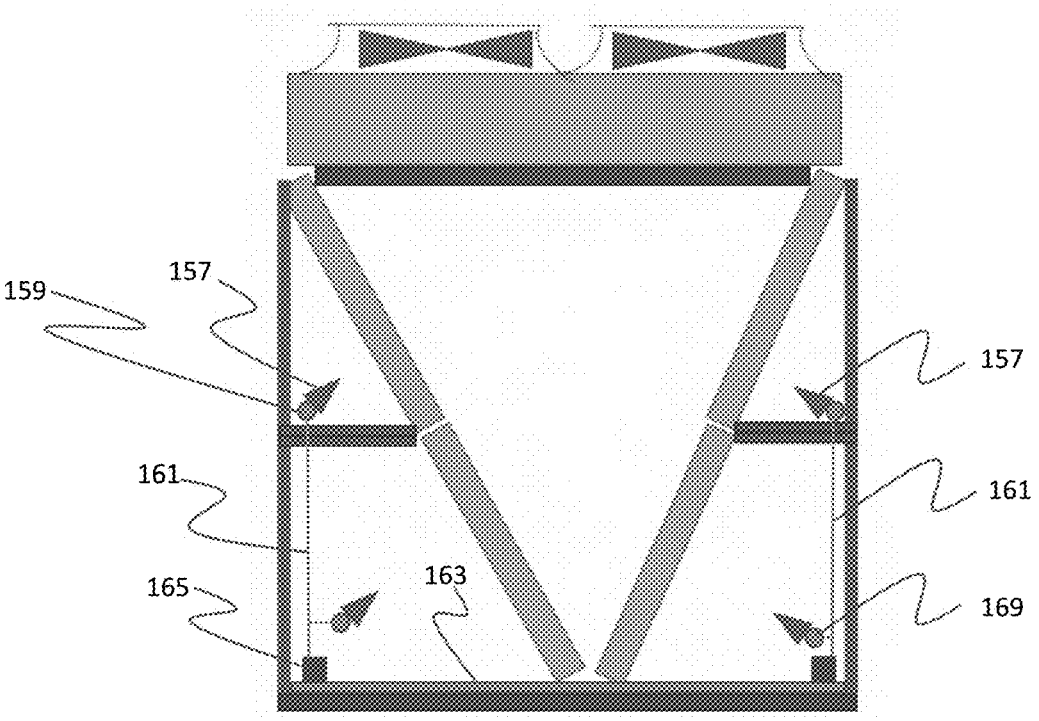
FIG. 12 is a representation of a modular double V-stack air-cooled heat exchanger with pre-cooling adiabatic spray nozzles according to an embodiment of the invention.

According to another optional embodiment (FIG. 12), instead of having adiabatic pre-cooling pads, the top and bottom modules may be provided with a pre-cooling spray system including spray nozzles 157 located and configured to spray water into the incoming air flow. The spray nozzles 157 may be attached to and fed by spray nozzle supply tubes 159 which receive fresh water from a fresh water supply or, in the case that unused water collected in a water collection basin, water return tubes 161.

According to one embodiment, each of the top and bottom modules may have separate and independent water supply, collection and water recirculation (or drain) systems, whether using adiabatic pads or adiabatic pre-cooling spray nozzles. According to an alternate embodiment, there may be an integrated water supply collection and recirculation (or drain system) in which all water supplied to the system is collected at the bottom of the bottom module in a basin or set of trays 163, and drained, or returned to various water distribution locations in the top and bottom modules via water return tubes 161 supplied by one or two pumps 165 located in the bottom module.

Figure 7:
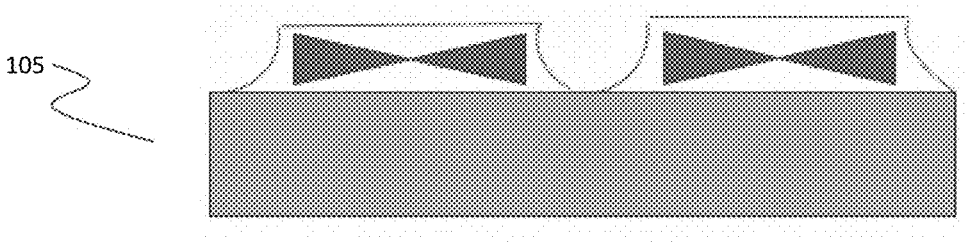
FIG. 7 is a representation of a standard fan size module according to an embodiment of the invention.
Figure 8:
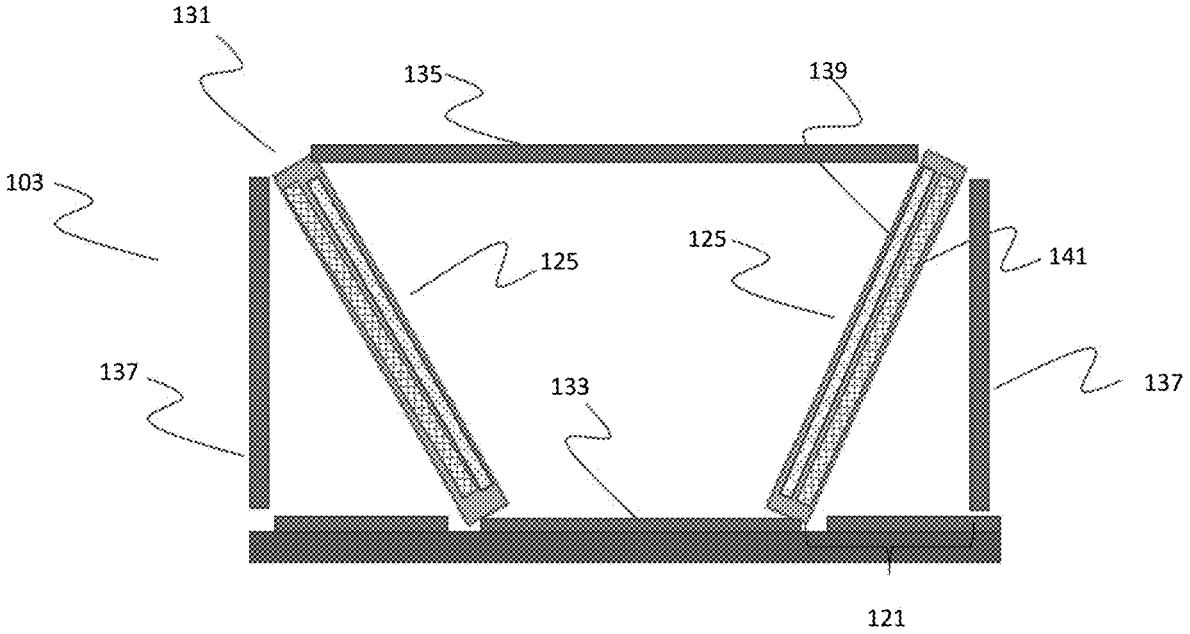
FIG. 8 is a representation of a top heat exchange module according to an embodiment of the invention.
Figure 9:
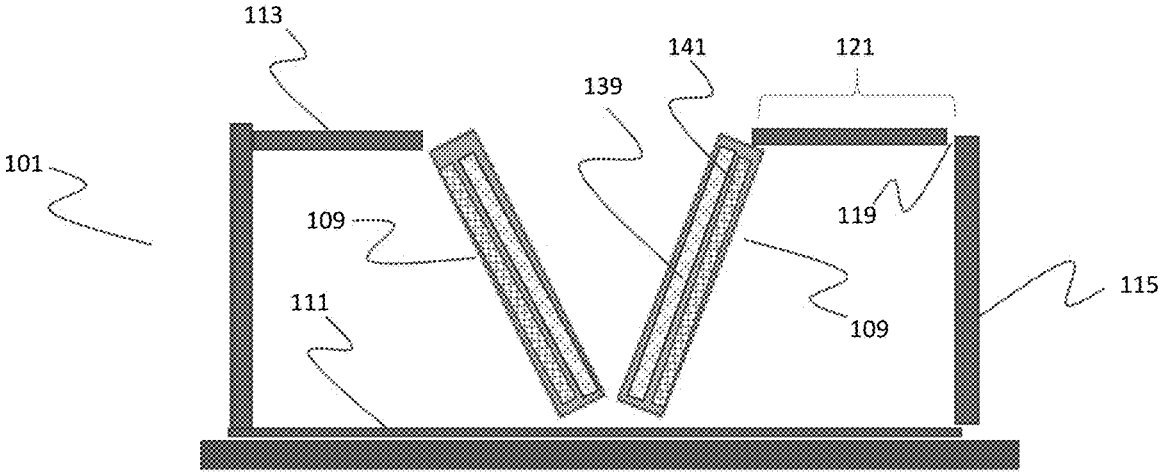
FIG. 9 is a representation of a bottom heat exchange module according to an embodiment of the invention.
Figure 10:
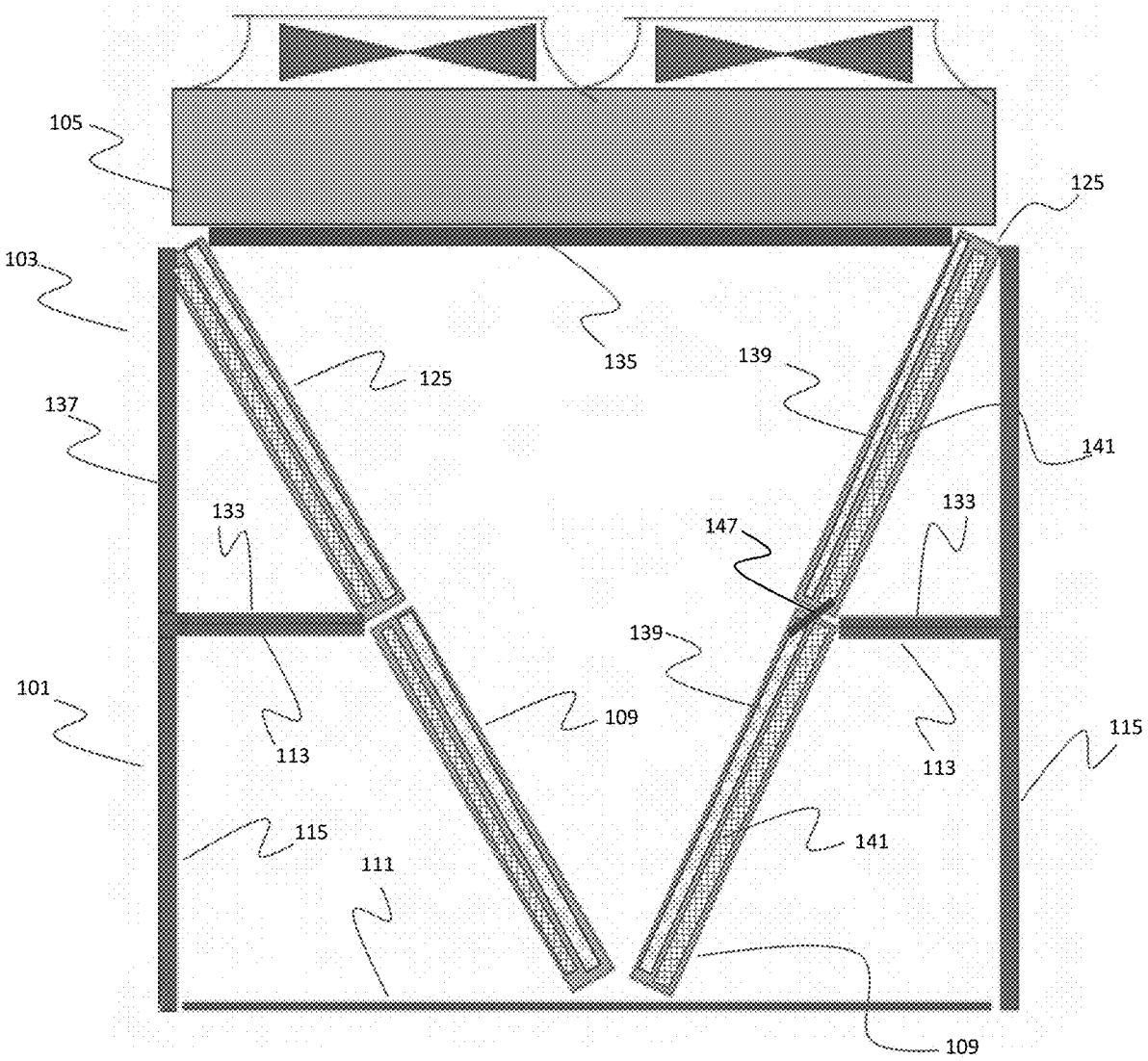
FIG. 10 is a representation of a modular double V-stack air-cooled heat exchanger according to an embodiment of the invention.
Figure 13:
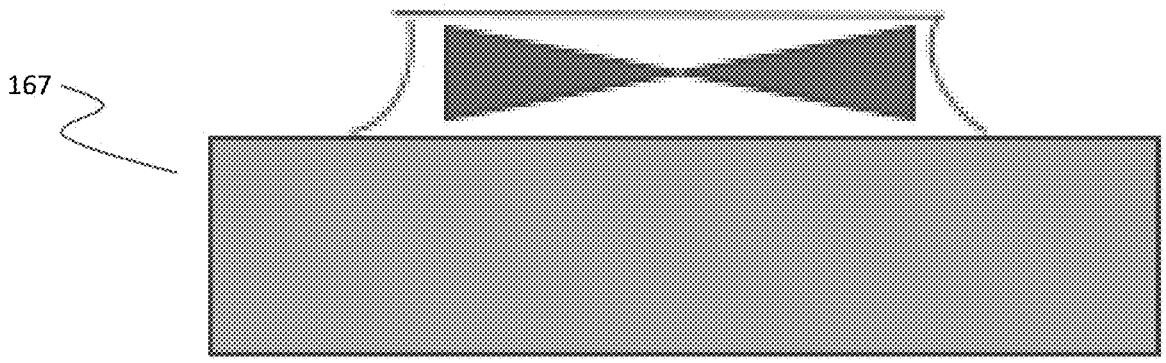
FIG. 13 is a representation of a large fan module according to another embodiment of the invention.
Figure 14:
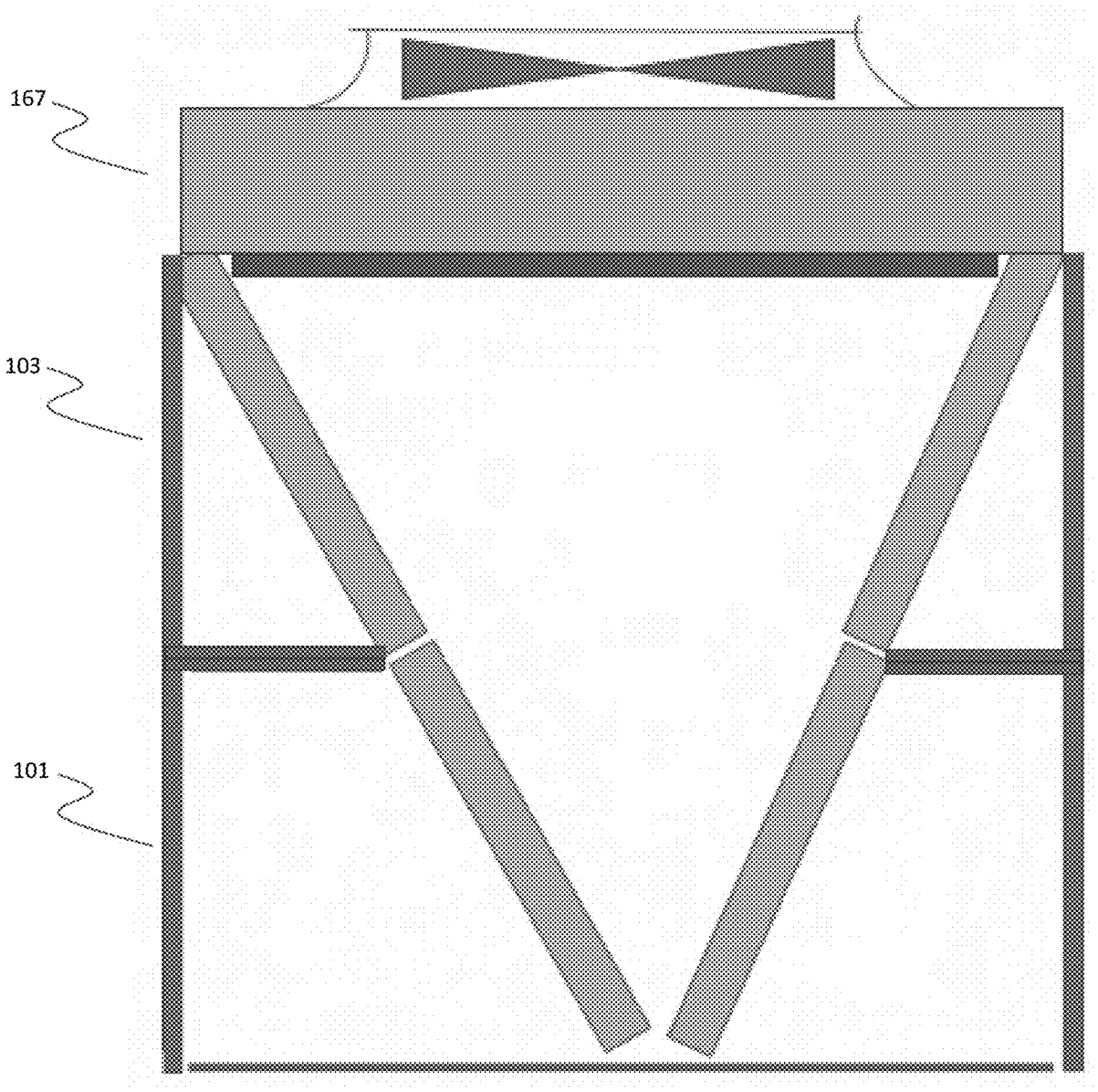
FIG. 14 is a representation of a modular double V-stack air-cooled heat exchanger according to a large fan module embodiment of the invention.
Figure 15:
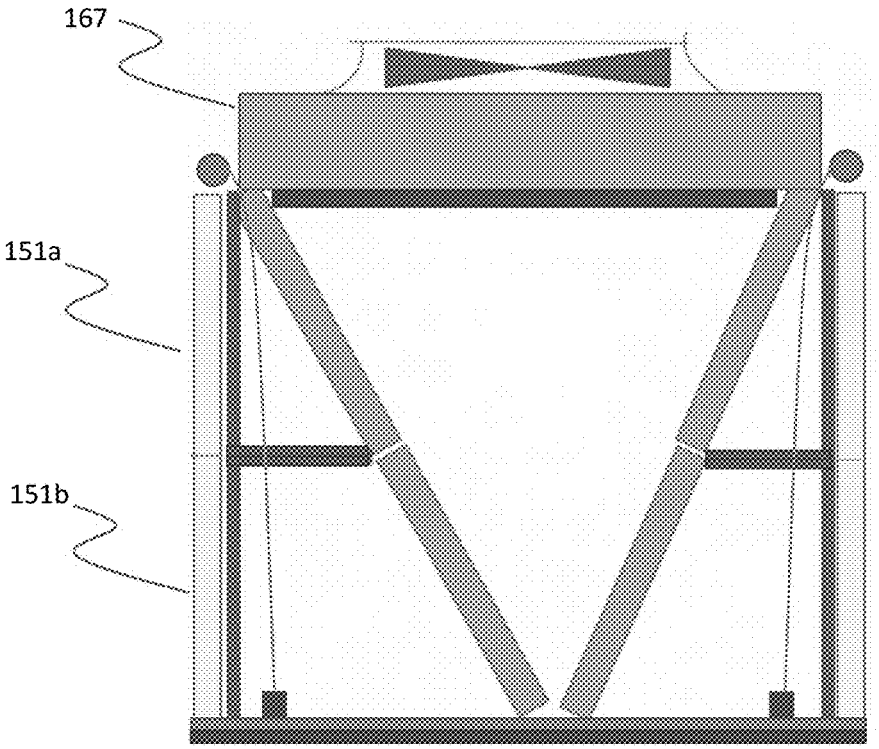
FIG. 15 is a representation of a modular double V-stack air-cooled heat exchanger with pre-cooling adiabatic pads according to another large fan module embodiment of the invention.
Figure 16:
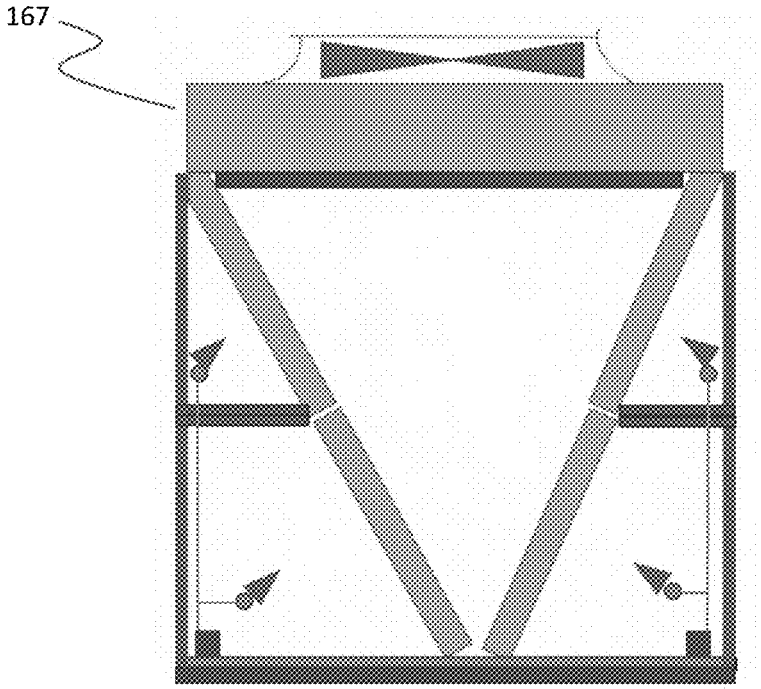
FIG. 16 is a representation of a modular double V-stack air-cooled heat exchanger with pre-cooling adiabatic spray nozzles according to another large fan module embodiment of the invention.

FIG. 13 shows a large fan module 167 which may be used in place of the module 105 of FIG. 7 in which two or more smaller fans are used. In the large fan module embodiment, the fan or fans have a diameter that is greater than 60% of the distance that separates the tops of the two top heat exchangers 126. As with the embodiment of FIG. 7, the large fan module 167 is dimensioned and configured to rest upon and be supported by the top heat exchange module 103. FIGS. 14-16 show large fan embodiments corresponding to the otherwise identical embodiments of FIGS. 10-12.

Figure 17:
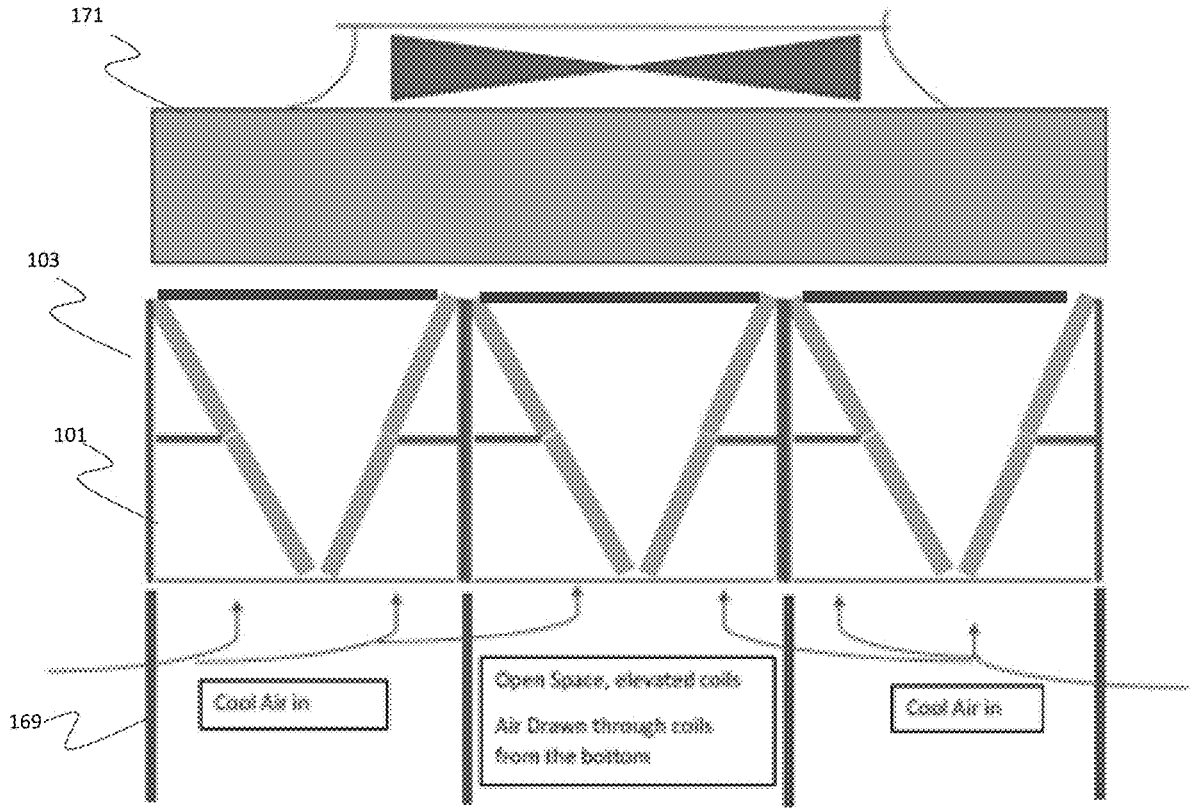
FIG. 17 is a representation of an embodiment of the invention in which multiple double-V-stack heat exchanger cells are mounted on an elevation frame beneath a very large fan.

According to another embodiment of the invention, represented in FIG. 17, multiple top and bottom heat exchange modules may be mounted adjacent to one another in a line or in a rectangular matrix on a elevating frame 169. According to this embodiment, a single very large fan module 171 may be positioned on top of a matrix of V-shaped modular heat exchangers to draw air into and through the open space created by the elevating frame 169 and up through the plurality of bottom and top heat exchange modules. In the case of the this embodiment, a single fan draws air through at least two, and preferably three, four, five or six double v-stacked cells. The bottom elevated air sections may be equipped with adiabatic pre-cooling pads and/or sprays to pre-cool the entering air.

Figure 18:
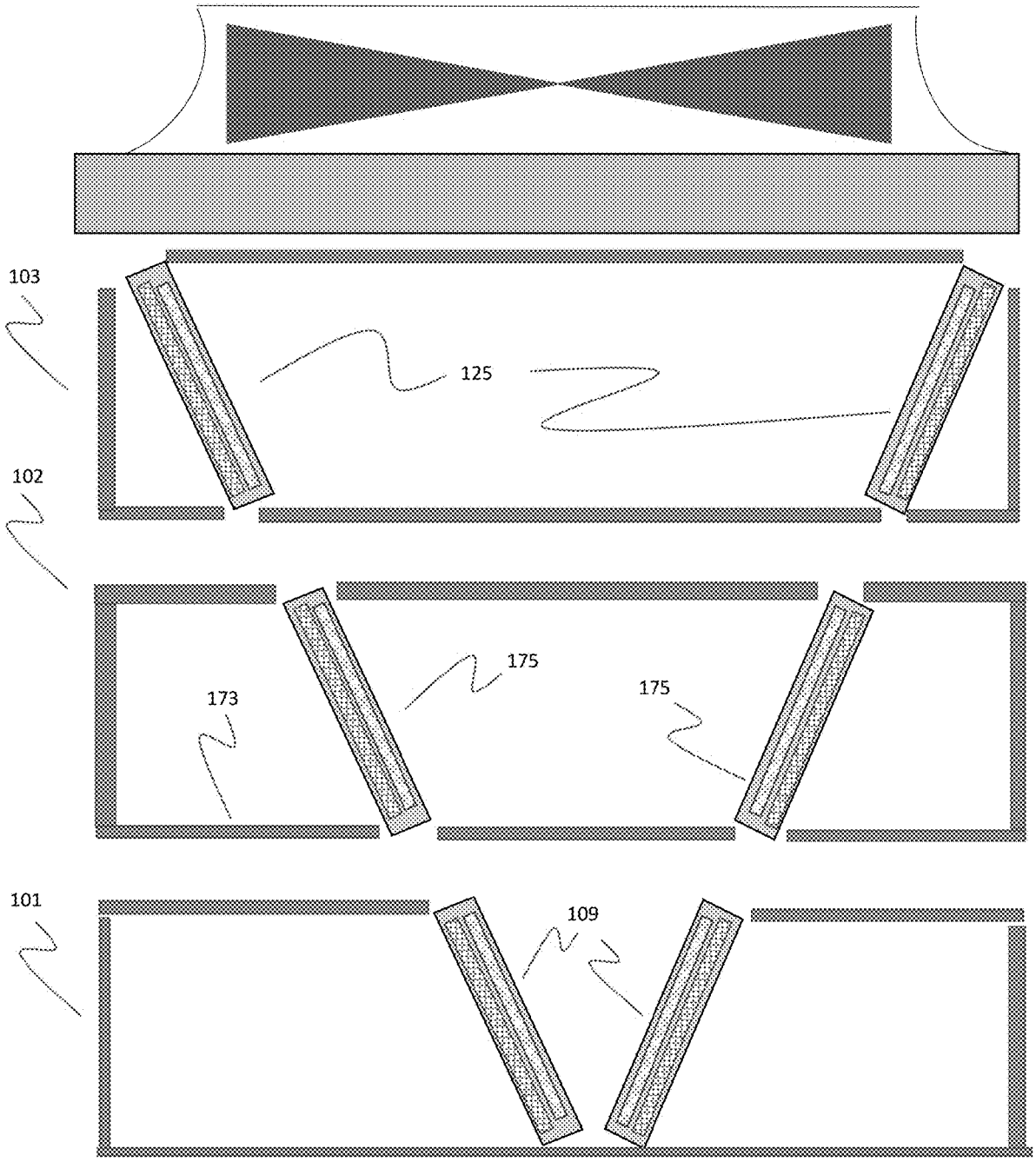
FIG. 18 is a representation of an embodiment of the invention in which an intermediate module may be placed between a top module and a bottom module to result in a triple V-stack air cooled heat exchanger.
Figure 19:
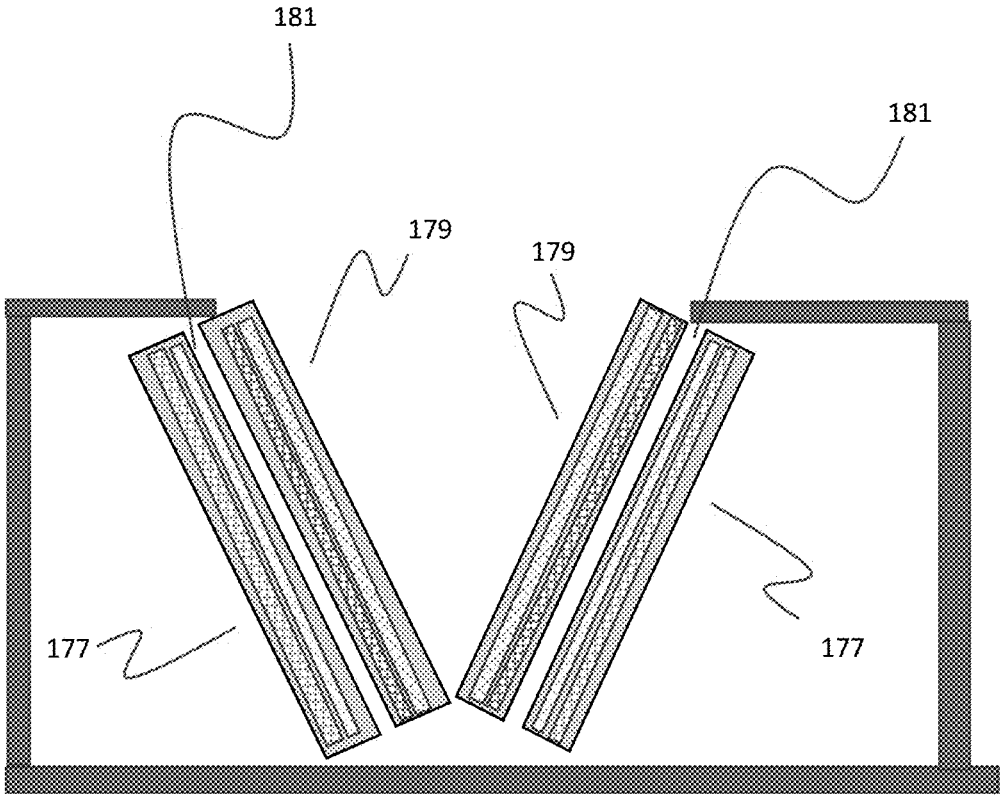
FIG. 19 is a representation of an embodiment of the invention in which one or more modules may have a second set of coils.

According to another embodiment of the invention, represented in FIG. 18, one or more intermediate heat exchange modules 102 may be placed between the top and bottom heat exchange modules 101, 103 to result in triple, quadruple, or more V-stacked air-cooled heat exchangers. According to this embodiment, each intermediate heat exchange module 102 includes intermediate heat exchange coils 175 supported in an intermediate module frame 173. The triple, quadruple or more V-shaped stacked modular air-cooled heat exchanger according to the invention may have a single very large fan module, or a fan module with two or more fans. Additionally, the triple, quadruple or more V-shaped stacked modular air-cooled heat exchanger according to the invention, may be optionally fitted with adiabatic pads or adiabatic spray systems as described above.

According to another embodiment of the invention, one or more of the heat exchange modules in a V-shaped stacked modular air-cooled heat exchanger of the invention may include a second set of coils nested proximate the first set of coils, separated by a space. According to this embodiment, a bottom, top or intermediate module (or combination thereof) has a set of low temperature process fluid coils 177, and a second set of high temperature process fluid coils 179. The low temperature process fluid coils 177 are preferably located on the air intake side of the module and the high temperature process fluid coils 179 are located on a plenum side of the module. According to this embodiment, ambient air drawn into the module, for example at 80° F., first passes through the low temperature process fluid coils 177, cooling the low temperature process fluid, for example from 100° F. to 90° F., warming the air to 88° F. The warmed air then passes through a space 181 between the coils and then passes through the high temperature process fluid coils 179, cooling the hot process fluid, for example, from 130° F. to 115° F., further heating the ambient air which leaves the module now heated to, for example 110° F. It is noted that the air and process fluid temperatures mentioned above are merely for exemplary purposes. The high temperature process fluid and the low temperature process fluid may be different fluids entirely, generated by different process. Alternatively, the low temperature process fluid may be the same fluid as the high temperature process fluid, in which the process fluid first flows through a high temperature process fluid coil, and subsequently through a low temperature process fluid coil.

It is specifically contemplated that every feature embodiment disclosed herein may be used together with every other feature and embodiment disclosed herein.

The description of the invention is merely exemplary in nature and, thus, variations that do not depart from the concept of a modular double-V-stacked cooler or condenser are intended to be within the scope of the invention. Any variations from the specific embodiments described herein but which otherwise constitute modular double-V-stacked cooler or condenser should not be regarded as a departure from the spirit and scope of the invention set forth in the following claims.

The invention claimed is:

1. A modular heat exchange apparatus, comprising:

exactly three factory assembled and transportable modules stacked in exactly three levels, arranged as follows:

a first level of said exactly three levels having exactly one unitary factory assembled and transportable bottom heat exchange module having two bottom module heat exchange panels arranged and supported in said bottom module in a V-shape, a second level of said exactly three levels having exactly one unitary factory assembled and transportable top heat exchange module having two top module heat exchange panels arranged and supported in said top module so that said two top module heat exchange panels continue and extend the V-shape formed by said two bottom module heat exchange panels, said top heat exchange module being supported by said bottom heat exchange module;

a third level of said exactly three levels having exactly one unitary factory assembled and transportable fan module having at least one fan, said fan module positioned on top of and supported by said top heat exchange module in said second level, said at least one fan positioned and configured to draw air through said two bottom module heat exchange panels and said two top module heat exchangers.

2. The modular heat exchange apparatus according to claim 1, each of said two bottom module heat exchange panels and said two top module heat exchange panels having an inlet header and an outlet header, said inlet header configured and located to receive hot process fluid and to distribute it to a corresponding heat exchange panel and said outlet header configured and located to receive cooled process fluid from said heat exchange panel;

each of said two bottom module heat exchange panels and said two top module heat exchange panels comprising a plurality of horizontally arranged finned tubes connected to adjacent tubes with tube bends.

3. The modular heat exchange apparatus according to claim 2, wherein each of said two bottom module heat exchange panels and said two top module heat exchange panels contain the same process fluid.

4. The modular heat exchange apparatus according to claim 2, wherein at least one of said two bottom module heat exchange panels and said two top module heat exchange panels contains a first process fluid, and wherein at least a second of said two bottom module heat exchange panels and said two top module heat exchange panels contains a second process fluid different from said first process fluid.

5. The modular heat exchange apparatus according to claim 2, wherein at least one of said two bottom module heat exchange panels and said two top module heat exchange panels contains a first process fluid, and wherein at least a second of said two bottom module heat exchange panels and said two top module heat exchange panels contains no process fluid.

6. The modular heat exchange apparatus according to claim 1, further comprising adiabatic panels.

7. The modular heat exchange apparatus according to claim 1, further comprising spray nozzles configured to spray water into an air flow entering said bottom and top heat exchange modules.

8. The modular heat exchange apparatus according to claim 1, wherein each of said top module heat exchange panels share a common plane with an adjacent one of said bottom module heat exchange panels.

9. The modular heat exchange apparatus according to claim 1, wherein said bottom heat exchange module comprises a second set of heat exchange panels each arranged parallel to and separated by a space from a respective one of said bottom heat exchange panels, wherein said second set of heat exchange panels contains a process fluid at a temperature that is different from a process fluid temperature in said bottom heat exchange panels.

10. The modular heat exchange apparatus according to claim 1, wherein said top heat exchange module comprises a second set of heat exchange panels each arranged parallel to and separated by a space from a respective one of said top heat exchange panels, wherein said second set of heat exchange panels contains a process fluid at a temperature that is different from a process fluid temperature in said top heat exchange panels.

11. The modular heat exchange apparatus according to claim 1, wherein said top heat exchange module is in contact with and directly supported by said bottom heat exchange module.

12. The modular heat exchange apparatus according to claim 1, wherein said top heat exchange module is in contact with and directly supported by said bottom heat exchange module with no fan module positioned between said top and bottom heat exchange modules.

13. The modular heat exchange apparatus according to claim 1, wherein said top heat exchange module contains a plenum section situated between said two top module heat exchange panels and wherein said bottom heat exchange module contains a plenum section situated between said two bottom module heat exchange panels.

* * * * *